US011988082B2

(12) United States Patent
Xiao et al.

(10) Patent No.: US 11,988,082 B2
(45) Date of Patent: May 21, 2024

(54) DOWNHOLE SOLIDS HANDLING IN WELLS

(71) Applicant: SAUDI ARABIAN OIL COMPANY, Dhahran (SA)

(72) Inventors: Jinjiang Xiao, Dhahran (SA); Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/079,795

(22) Filed: Dec. 12, 2022

(65) Prior Publication Data

US 2023/0109245 A1 Apr. 6, 2023

Related U.S. Application Data

(62) Division of application No. 16/919,819, filed on Jul. 2, 2020, now Pat. No. 11,525,348.

(51) Int. Cl.

| | |
|---|---|
| ***E21B 43/34*** | (2006.01) |
| ***E21B 43/12*** | (2006.01) |
| ***E21B 43/38*** | (2006.01) |

(52) U.S. Cl.

CPC ..... *E21B 43/35* (2020.05); *E21B 43/121* (2013.01); *E21B 43/38* (2013.01)

(58) Field of Classification Search

CPC ..... E21B 43/38; E21B 43/121

See application file for complete search history.

(56) References Cited

U.S. PATENT DOCUMENTS 5,207,897 A * 5/1993 Baird ..... E21B 43/121 166/265

2019/0368311 A1* 12/2019 Krawiec ..... E21B 43/127

FOREIGN PATENT DOCUMENTS

RU 2006574 C1 * 1/1994

* cited by examiner

*Primary Examiner* — Robert E Fuller

(74) *Attorney, Agent, or Firm* — Osha Bergman Watanabe & Burton LLP

(57) ABSTRACT

A solids collector is disposed at an end of a tubing in a wellbore. At a top of the solids collector, a reservoir fluid stream carrying solids is separated into a solids-liquid stream that is reversed into an annulus in the solids collector and a gas stream that continues to move uphole in the wellbore. At an end of the annulus in the solids collector, the solids-liquid stream is separated into a liquid stream that moves up the tubing and solids that are accumulated in the solids collector.

5 Claims, 8 Drawing Sheets

DOWNHOLE SOLIDS HANDLING IN WELLS

CROSS-REFERENCE TO RELATED APPLICATIONS

This Application is a Divisional of application Ser. No. 16/919,819 filed on Jul. 2, 2020. The entire contents of these applications are incorporated herein by reference in their entirety.

BACKGROUND

Long horizontal wells are commonly drilled in the oil and gas industry to ensure maximum contact with a hydrocarbon bearing reservoir. Some of these wells are fitted with artificial lift systems to facilitate fluid production. However, long horizontal wells are susceptible to slugging flows, which in turn is detrimental to performance of the artificial lift system and subsequently affects the economic bottom line for the operator. Effective control of these slugging flows is therefore essential and beneficial for efficient production operations.

One of the current commercial systems used to control slugging flows downhole, separate fluids and solids downhole, and produce fluids to the surface is the Horizontal Enhanced Artificial Lift (HEAL) system, which is described, for example, in U.S. Patent application Ser. No. 2018/0100384 (Saponja et al.). In the HEAL system, solids, liquid, and gas flow from a horizontal section of the well into a sized regulating tubing, which conditions the flow to ensure there is no slugging flow. At the end of the regulating tubing, a vortex separator separates the solids, liquid, and gas. The gas flows up an annulus between a pump and a casing to the surface, whereas the liquid and solids flow downwards by gravity. The liquid reverses direction around a corner and flows upwards towards the pump, while the solids continue their downward flow, where they accumulate at the HEAL seal within a solids sump.

The solids sump of the HEAL system is part of the casing in the well. Over time, solids accumulate in the sump, and the level of the solids rises to the turning corner where the liquid is separated from the solids. When this occurs, liquid supply is cut off from the pump. In other words, the pump can run dry or is starved of liquids. In addition, solids can be sucked into the inlet of the pump. Either or a combination of these events will result in a premature failure of the artificial lift system. In a more advanced case, even if the pump is shut in to prevent liquid starvation and solids ingestion, solids can also accumulate up to the discharge of the vortex separator. When this occurs, gas production stops, and the entire system is no longer operative.

SUMMARY

In one aspect of the disclosure, a system for handling solids downhole includes a receptacle disposed in a wellbore. The receptacle has a top end, a closed bottom end, and a chamber between the top end and the closed bottom end. The receptacle is positioned to form a first annulus between the receptacle and the wellbore. The system includes a first tubing disposed in the wellbore and positioned to form a second annulus between the first tubing and the receptacle. The second annulus is fluidly connected to the chamber. The system includes a second tubing disposed in the wellbore and positioned to form a third annulus between the second tubing and the wellbore. The third annulus is fluidly connected to the first annulus, and the second tubing is fluidly connected to the first tubing. The system includes a first separation region formed at an end of the first annulus to separate a fluid stream carrying solids into a first separated stream that is reversed in direction into the second annulus and a second separated stream that continues to move in an uphole direction into the third annulus. The system includes a second separation region formed at an end of the first tubing to separate the first separated stream into a third separated stream that is reversed in direction into the first tubing and a fourth separated stream that continues to move in a downhole direction into the chamber.

The first separated stream may include a liquid component of the fluid stream and the solids, and the second separated stream may include a gas component of the fluid stream. The first tubing may extend into the chamber. The first separation region may be located proximate the top end of the receptacle. The second separation region may be located proximate a bottom end of the first tubing inside the chamber. The receptacle may be physically coupled to the first tubing, which may be physically coupled to the second tubing. The second tubing may be a production tubing. The system may include an artificial lift system disposed along the second tubing and operable to lift the third separated stream received in the first tubing up the second tubing.

The receptacle may include at least one port that is fluidly connected to the second annulus. The system may include an inlet check valve positioned in the at least one inlet port to control flow into the second annulus. The inlet check valve may be responsive to a pressure of the fluid stream. The receptacle may include at least one outlet port that is fluidly connected to the chamber. The system may include an outlet check valve positioned to control flow out of the at least one outlet port. The outlet check valve may be responsive to a fluid pressure inside the chamber. The system may include an artificial system disposed along the second tubing. The artificial lift system may be operable in a first mode to lift the third separated stream received in the first tubing up the second tubing and in a second mode to increase the fluid pressure within the chamber to at least a threshold pressure at which the outlet check valve opens.

In another aspect of the disclosure, an apparatus for handling solids includes a receptacle having a top end, a closed bottom end, and a chamber. The top end has at least one inlet port and a central bore. A first tubing is inserted into the chamber through the central bore. A second tubing is physically and fluidly connected to the first tubing. An artificial lift system is disposed along the second tubing.

The receptacle may include at least one outlet port that is fluidly connected to the chamber. The apparatus may include an inlet check valve positioned to control flow through the at least one inlet port and an outlet check valve positioned to control flow through the at least one outlet port. The artificial lift system may be operable to pump fluid in a first direction in one mode and in a second direction that is opposed to the first direction in a second mode.

In yet another aspect of the disclosure, a method for handling solids downhole includes disposing a tubing in a wellbore. The method includes disposing a receptacle in the wellbore and proximate a bottom end of the tubing. The method includes receiving a reservoir fluid stream carrying solids in a first annulus formed between the receptacle and the wellbore from a producing zone of the wellbore. The method includes separating the reservoir fluid stream into a first separated stream and a second separated stream at a first separation region formed at an end of the first annulus. The first separated stream is reversed in direction into a second annulus formed between the tubing and receptacle. The second separated stream is directed in an uphole direction into a third annulus formed between the tubing and the wellbore. The first separated stream is separated into a third separated stream and a fourth separated stream at a second separation region formed at an end of the second annulus. The third separated stream is reversed in direction into the tubing. The fourth separated stream is directed in a downhole direction into a chamber of the receptacle.

The method may include lifting the third separated stream received in the tubing to a surface location. The method may include retrieving the tubing and receptacle to a surface location and emptying the chamber. The method may include conditioning the reservoir fluid stream to prevent slugging prior to separating the reservoir fluid stream.

The act of reversing the first separated stream in direction into the second annulus formed between the tubing and the receptacle may include directing the first separated stream into the second annulus through at least one inlet check valve positioned at an inlet of the second annulus. The method may include flushing out the chamber through one or more outlet ports formed in the receptacle by increasing a fluid pressure within the chamber to open at least one check valve positioned to control flow out of the one or more outlet ports. The act of increasing the fluid pressure within the chamber may include operating an artificial lift system disposed along the tubing to pump fluid into the chamber.

The act of separating the reservoir fluid stream into the first separated stream and the second separated stream at the first separation region may include separating out a liquid component of the reservoir fluid stream and the solids as the first separated stream and separating out a gas component of the reservoir fluid stream as the second separated stream. The act of separating the first separated stream into the third separated stream and the fourth separated stream at the second separation region may include separating out the liquid component carried by the first separated stream as the third separated stream and separating out the solids carried by the first separated stream as the fourth separated stream.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
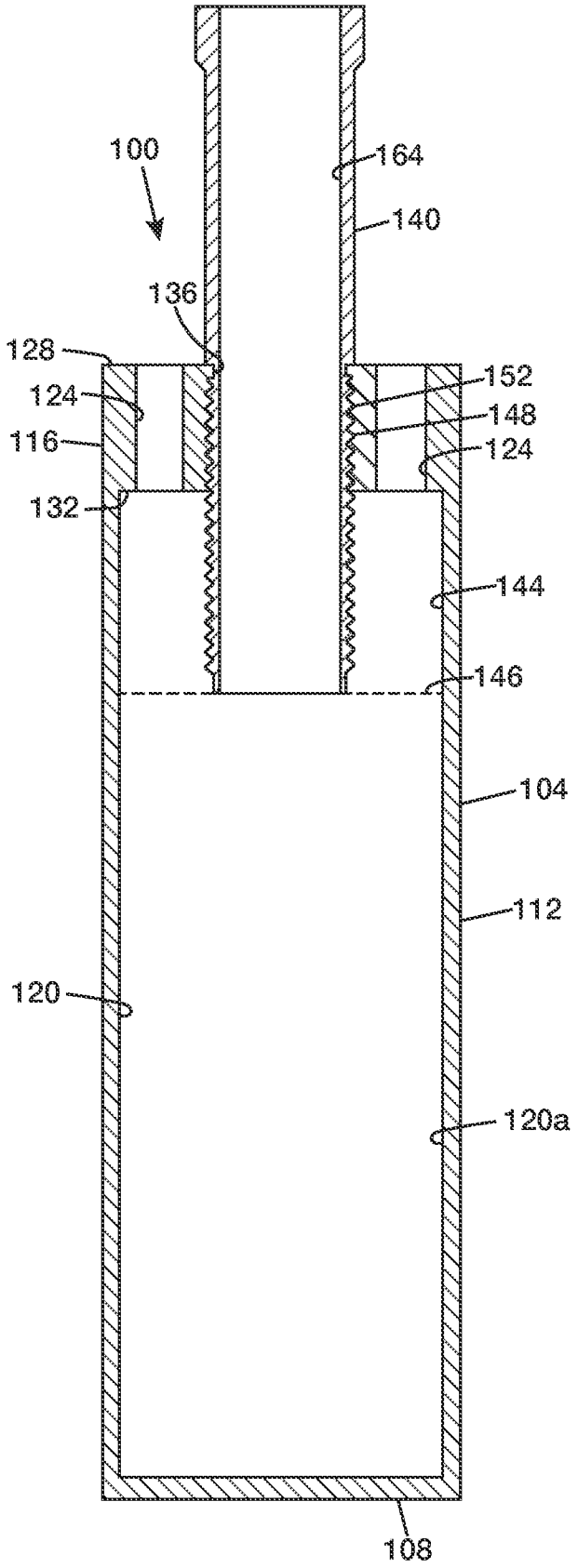
FIG. 1 is a cross-sectional view of a solids collector.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects or features in multiple figures.

System, method, and apparatus for handling solids after separating the solids from gas and liquid are described herein. The system, method, and apparatus effectively remove an accumulated amount of solids from the well. The system, method, and apparatus may provide a benefit of elongating production operation and improving the bottom line for the operator, especially in long horizontal wells with high sand concentrations.

FIG. 1 shows one illustrative implementation of a solids collector 100 that may be used in a wellbore to collect solids, e.g., sand and other granular materials, while producing reservoir fluids to the surface. Solids collector 100 includes a receptacle 104 having a bottom wall 108, a side wall 112, and a top wall 116. Receptacle walls 108, 112, 116 form a chamber 120. The volume of chamber 120 defines the amount of solids that can be accumulated in solids collector 100. The dimensions of receptacle 104 can be suitably selected to provide the desired volume of chamber 120. Receptacle 104 has a tubular shape, which may be straight as shown. When receptacle 104 is deployed into a wellbore, receptacle 104 may conform to the shape of the wellbore. For example, if receptacle 104 is located in a bent portion of the wellbore, the receptacle may have a bent tubular shape when in the wellbore. Receptacle 104 may be made of joined pipes to achieve a desired length of the receptacle 104. One or more inlet ports 124 are formed in top wall 116. Inlet ports 124 are through-holes with openings located at the top and bottom surfaces 128, 132 of top wall 116. Inlet ports 124 may be straight cylindrical holes as shown but are not limited to straight cylindrical holes. For example, inlet ports 124 may be tapered holes, having larger openings on the top surface 128 than on the bottom surface 132. In another example, an inlet port that is a spiral hole may be formed in top wall 116 with openings of the port located at the top and bottom surfaces 128, 132 of top wall 116. Inlet ports 124 allow a stream, e.g., a solids-liquid stream, to enter chamber 120.

Top wall 116 includes a central bore 136. A tubing 140 is disposed in central bore 136 and extends into chamber 120.

Figure 2:
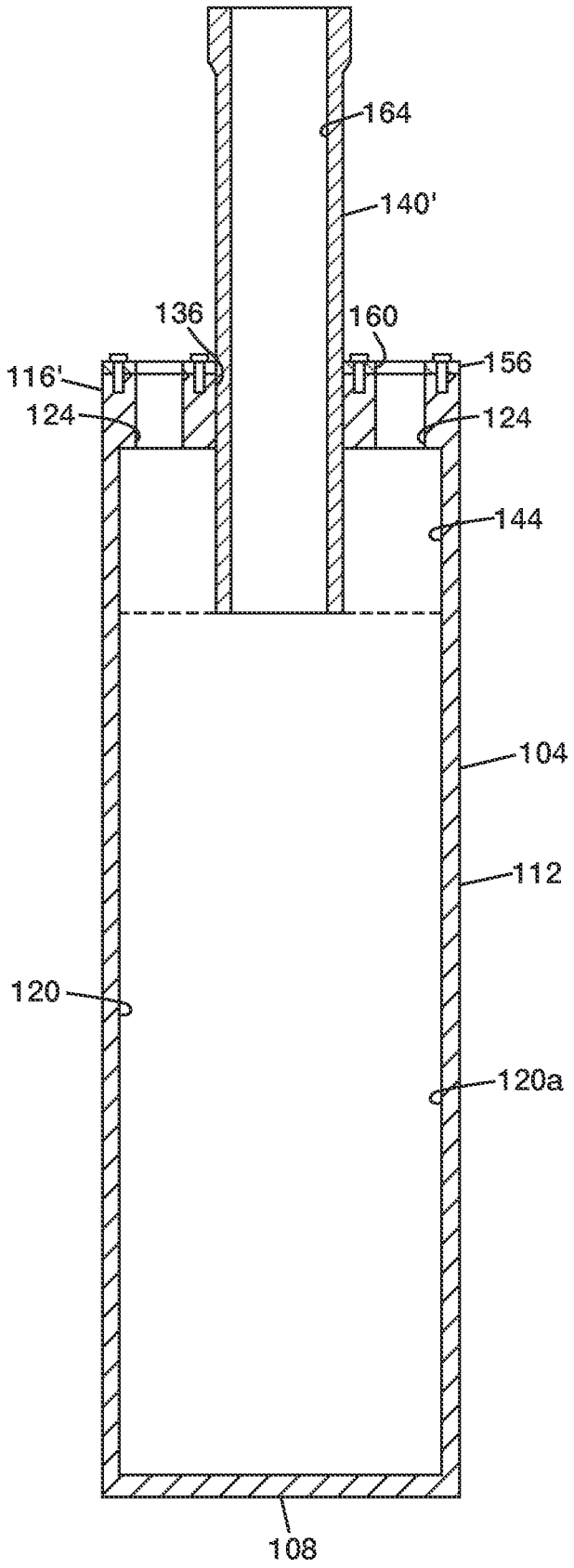
FIG. 2 is a cross-sectional view of an alternative solids collector showing a flanged connection between a tubing and a receptacle.

An annulus 144 is defined between an inner surface of receptacle 104 and an outer surface of a portion of tubing 140 disposed inside chamber 120. Annulus 144 may be referred to as a collector-tubing annulus. Collector-tubing annulus 144 is located in an upper part of chamber 120 and is fluidly connected to inlet ports 124. An imaginary line 146 is shown demarcating collector-tubing annulus 144 from chamber portion 120*a* below tubing 140. In reality, collector-tubing annulus 144 and chamber portion 120*a* are fluidly connected. An outer surface of tubing 140 may include a threaded section 148. An inner surface of top wall 116 defining central bore 136 may include threaded section 152 that is complementary to the threaded section 148. Threaded sections 148, 152 may engage each other to form a threaded connection between tubing 140 and receptacle 104 and thereby secure tubing 140 to receptacle 104. Alternatively, a flanged connection may be used to secure tubing 140 to receptacle 104. As shown in FIG. 2, tubing 140' may carry a flange 156 that can be fastened to receptacle 104, e.g., by bolts. In this case, flange 156 may have holes 160 that are aligned with inlet ports 124 in top wall 116' in order to allow a stream, e.g., a solids-liquid stream, to flow through flange 156 into inlet ports 124. Alternatively, a weld connection may be used to fasten tubing 140 to receptacle 104.

Figure 3:
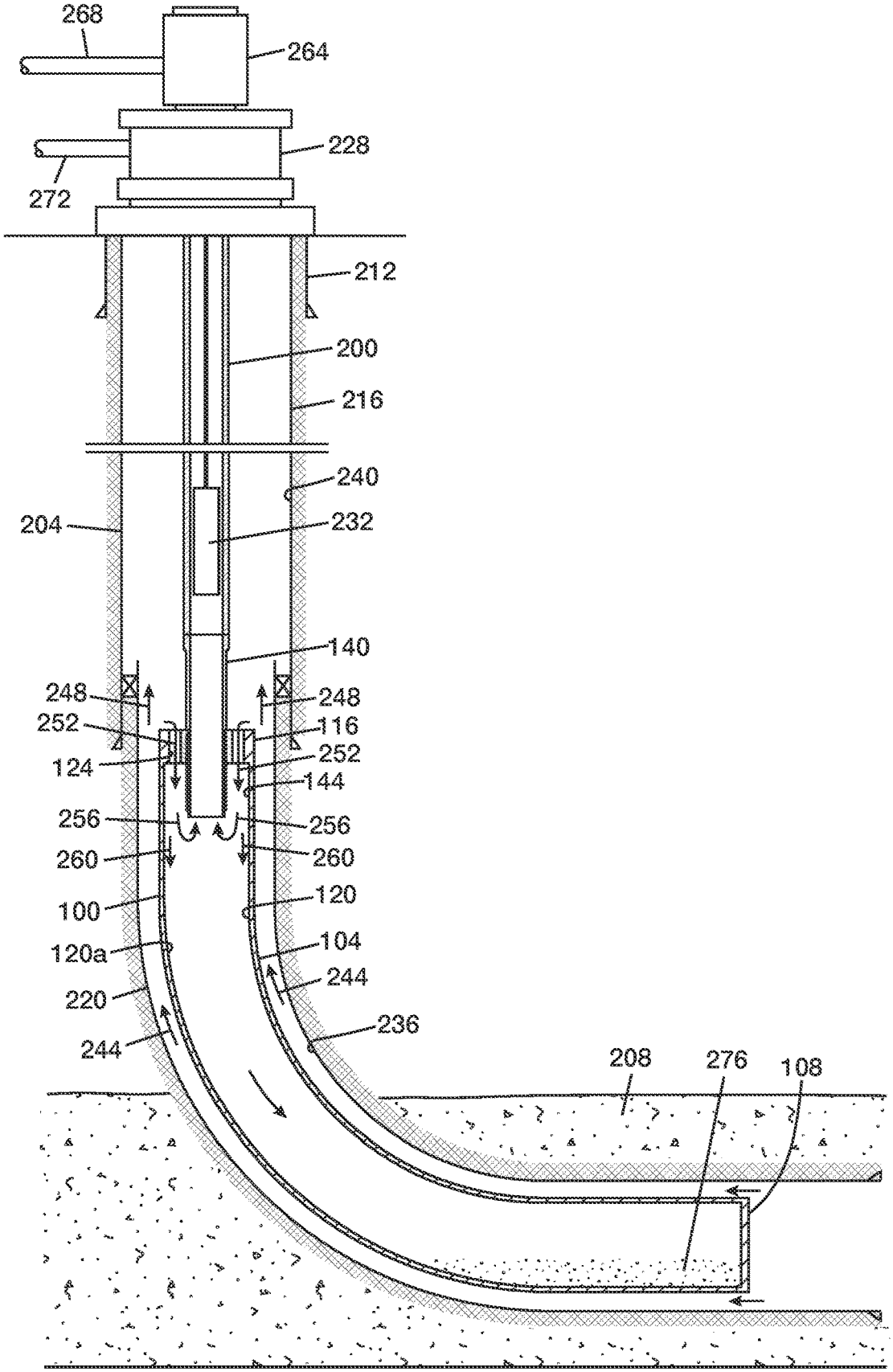
FIG. 3 is a schematic view of a production system including a solids collector as shown in FIG. 1 or FIG. 2.

FIG. 3 shows an exemplary production system where tubing 140 of solids collector 100 is attached to a downhole end of a wellbore tubular 200 that is disposed in a wellbore 204. Tubing 140 may be attached to wellbore tubular 200 using any suitable method for connecting tubing joints together. Wellbore tubular 200 may be a production tubing, i.e., a tubing used to produce reservoir fluids. In the exemplary system, wellbore 204 traverses a reservoir 208, which may be a hydrocarbon bearing reservoir. In this case, reservoir fluids may include, for example, oil, water, and hydrocarbon gases. Casings 212, 216, and liner 220 may be installed in wellbore 204. A liner is a casing that does not extend to the top of the wellbore. In the illustrated example, liner 220 is hung from casing 216. The number of casings illustrated is not intended to be limiting. In some cases, a casing that extends to the top of the wellbore may be used instead of liner 220. In the illustrated example, liner 220 extends into reservoir 208 and may include perforations or wall openings (not shown separately) to allow reservoir fluids from reservoir 208 to enter into wellbore 204. Wellbore tubular 200 may be suspended in wellbore 204 by means of a tubing hanger (not shown) in a surface wellhead 228. An artificial lift system 232 may be disposed along wellbore tubular 200. An artificial lift system adds energy to reservoir fluid or leverages the energy of the reservoir fluid to produce the fluid to the surface. A pump is an example of an artificial lift system. The pump may be a positive displacement pump, centrifugal pump, or other type of pump that may be used to add energy to reservoir fluid. The pump may be driven from the surface or from downhole. Artificial lift system 232 is shown as through-tubing deployed. In other implementations, artificial lift system 232 could be installed as a component of wellbore tubular 200.

Figure 4A:
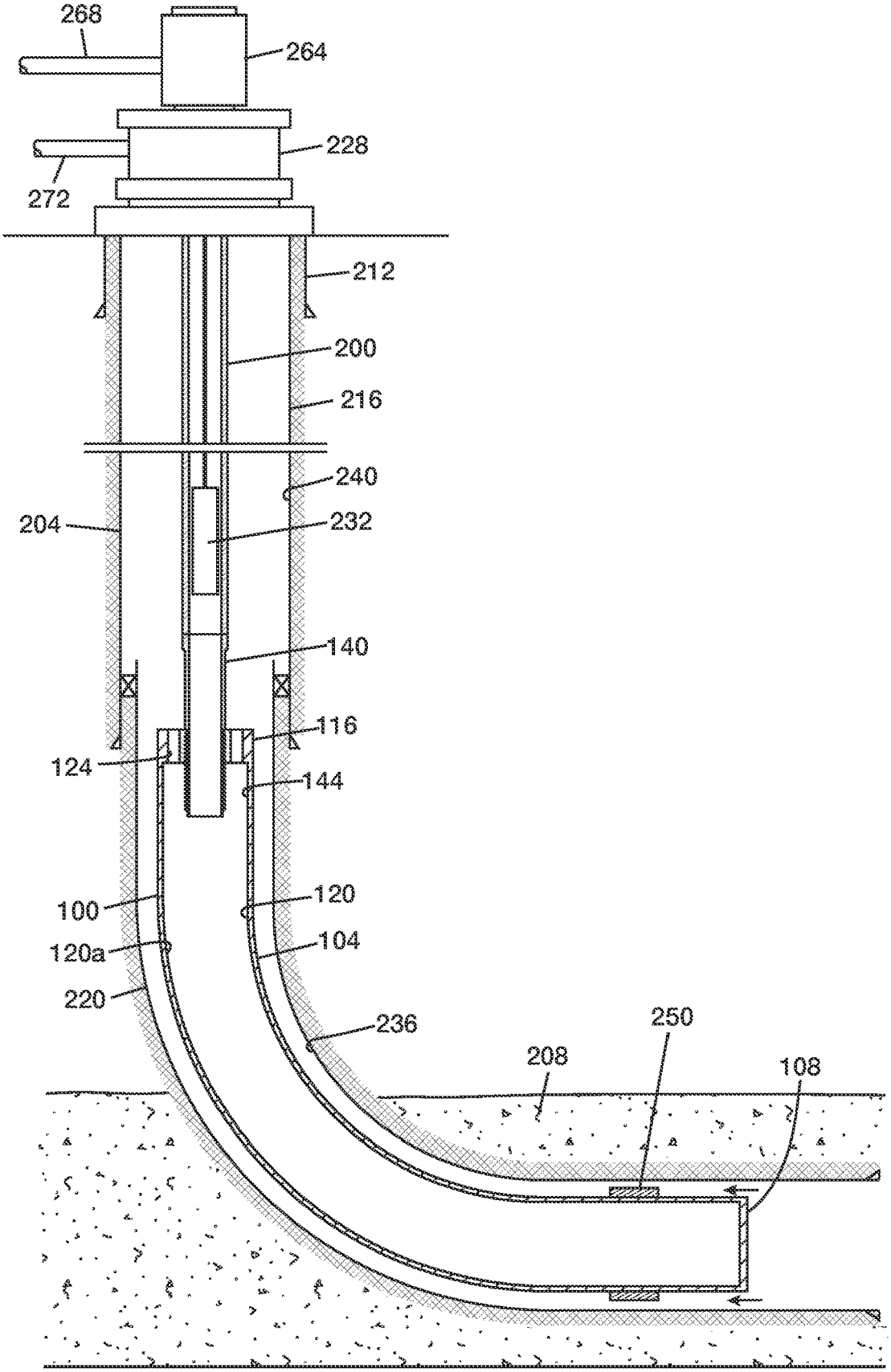
FIGS. 4A and 4B are schematic views of a production system including a solids collector as shown in FIG. 1 or FIG. 2 with a packer around the solids collector.
Figure 4B:
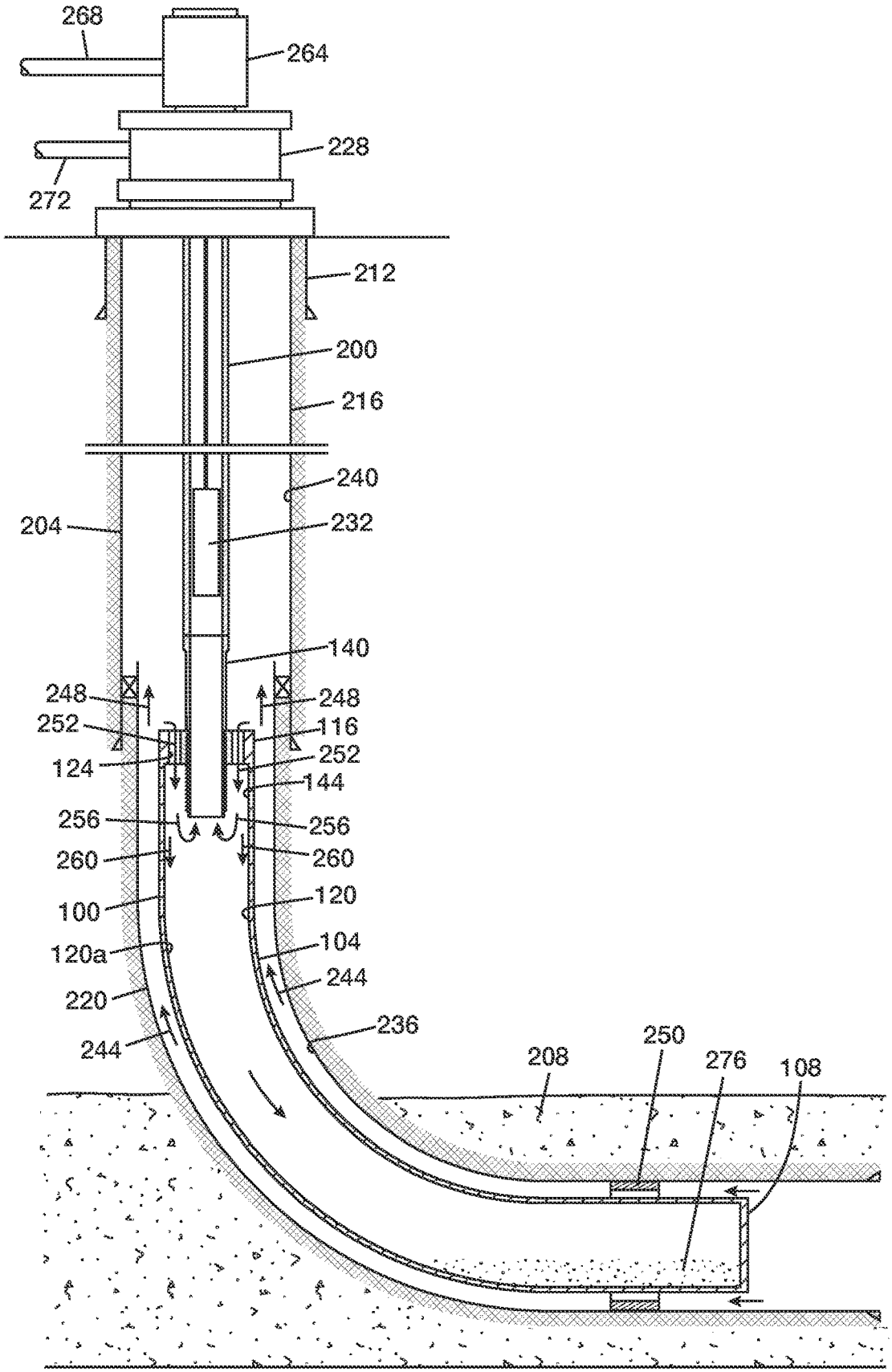

In the illustrated example, solids collector 100 is located within liner 220. Although not shown, solids collector 100 may also extend into an open hole section of the wellbore. In the illustrated example, solids collector 100 is in a bent section of wellbore 204, with a portion of solids collector 100 in a vertical section of wellbore 204 and another portion of solids collector 100 in a horizontal section of wellbore 204. An annulus 236 is formed between receptacle 104 of solids collector 100 and a portion of wellbore 204 including liner 220. Annulus 236 may be referred to as collector-casing annulus. Collector-casing annulus 236 extends from the bottom end of receptacle 104 (i.e., the end proximate bottom wall 108) to the top end of receptacle 104 (i.e., the end proximate top wall 116). An annulus 240 is formed between wellbore tubular 200 and a portion of wellbore 204 including casing 216. Annulus 240 may be referred to as tubing-casing annulus. Annulus 240 is fluidly connected to annulus 236. In some cases, as shown in FIG. 4A, a swellable packer 250 may be disposed around solids collector 100. Swellable packer 250 will expand to seal against the casing wall, e.g., wall of liner 220, during production. When swellable packer 250 expands, a path for flow of reservoir fluid stream will be created between the swellable packer and the solids collector, as shown in FIG. 4B.

Returning to FIG. 3, during production of fluids to the surface, a reservoir fluid stream enters wellbore 204 through liner 220 or through an open hole section of the wellbore. The reservoir fluid stream may include any combination of liquids, solids, and gases. The reservoir fluid stream enters collector-casing annulus 236 and moves uphole along collector-casing annulus 236, as shown by arrows 244. The hydraulic diameter of collector-casing annulus 236 can be selected such that the reservoir fluid stream is conditioned to prevent slugging. The hydraulic diameter can be determined from prior hydraulic simulation. Slugging flow is a flow regime experienced in horizontal and vertical conduits. It depends on fluid properties, flow conditions, and conduit dimensions. Typically, slug flow occurs at low superficial gas velocity. Therefore, to prevent slug flow, the superficial gas velocity needs to be increased. This can be achieved by reducing the flow area. In implementations herein, this is achieved by reducing the cross-sectional area of collector-annulus 236, i.e., by increasing the diameter of receptacle 104 of the solids collector. At the top of collector-casing annulus 236 is a first separation region where the reservoir fluid stream separates into a first stream that continues moving uphole along tubing-casing 240, as shown by arrows 248, and a second stream that reverses in direction and enters inlet ports 124 of solids collector 100, as shown by arrows 252. The first stream that continues to move uphole along tubing-casing 240 includes the gas component of the reservoir fluid stream, and the second stream that reverses in direction into inlet ports 124 includes the liquid and solid components of the reservoir fluid. There are two mechanisms involved in separation of the fluid stream. The gas preferentially has a higher velocity due to its lower density and will travel uphole compared to the liquid and solids. Mixture velocity decreases as area increases from annulus 236 to annulus 240. The lower velocity of the liquid and solids means insufficient inertia/momentum to flow upwards. Therefore, most of the liquid and solids will fall into the collector. The gas stream moving uphole along tubing-casing 240 may be diverted into a flowline 272 at surface wellhead 228. The gas may be combined with liquid production at the surface and transported together via surface flowline to processing plants.

The solids-liquid stream received in inlet ports 124 travels down collector-tubing annulus 144. At the bottom of tubing 140 is a second separation region where the solids-liquid stream separates into a third stream that reverses in direction and enters tubing 140, as shown by arrows 256, and a fourth stream that continues to move downward into chamber portion 120*a*, as shown by arrows 260. The third stream that reverses in direction and enters tubing 140 includes substantially a liquid component of the solids-liquid stream. The fourth stream that continues to move downward into chamber portion 120*a* includes substantially the solid component of the solids-liquid stream. The separation of the solids-liquid stream at the bottom of tubing 140 is aided by both gravity and suction created by the artificial lift system 232 at the bottom of tubing 140. Artificial lift system 232 is operated to pump the liquid stream entering tubing 140 up wellbore tubular 200 to the surface. At the surface, the liquid stream may enter a pumping tee 264 mounted on surface wellhead 228 and flow into a flowline 268 through a side outlet of pumping tee 264.

While the liquid stream is pumped to the surface, the solids settle within chamber 120. For illustration purposes, solids 276 are shown accumulating inside chamber 120. At scheduled intervals or when the amount of solids in chamber 120 rises to a given level, production is stopped and wellbore tubular 200 and solids collector 100 are retrieved to the surface. As an example, solids concentration in the well can be monitored at the surface. Based on the density of solids, and liquid production rate, the volume of solids can be estimated. The time for a certain volume of solids to equal the volume of the solids collector below the end of tubing 140 can be used as a guide to schedule retrieval of the solids collector to the surface. At the surface, solids collector 100 is emptied and serviced. To empty solids collector 100, tubing 140 is separated from wellbore tubular 200. After separating tubing 140 from wellbore tubular 200, tubing 140 may be separated from receptacle 104, which will leave the central bore 136 (in FIGS. 1 and 2) open. Solids in chamber 120 can be flushed out through central bore 136 and inlet ports 124 (in FIGS. 1 and 2). An alternative may be to provide receptacle 104 with a bottom wall that can be swung open in order to dump the contents of chamber 120. Another alternative may be to form an opening in the bottom wall (108 in FIGS. 1 and 2) of receptacle 104 and cover the opening with a gate that can be swung open in order to dump the contents of chamber 120. Receptacle 104 can be very long, e.g., 1 to 4 km in length, in order to prevent slugging in the long open hole section of the wellbore. In such case, receptacle 104 can be joined pipes. As each pipe joint is retrieved to the surface and disconnected from the rest of the receptacle 104, solids can be removed and flushed out of that pipe joint. After emptying solids collector 100 and performing any additional maintenance services on solids collector 100, solids collector 100 may be reattached to wellbore tubular 200 and returned to the well.

Figure 5:
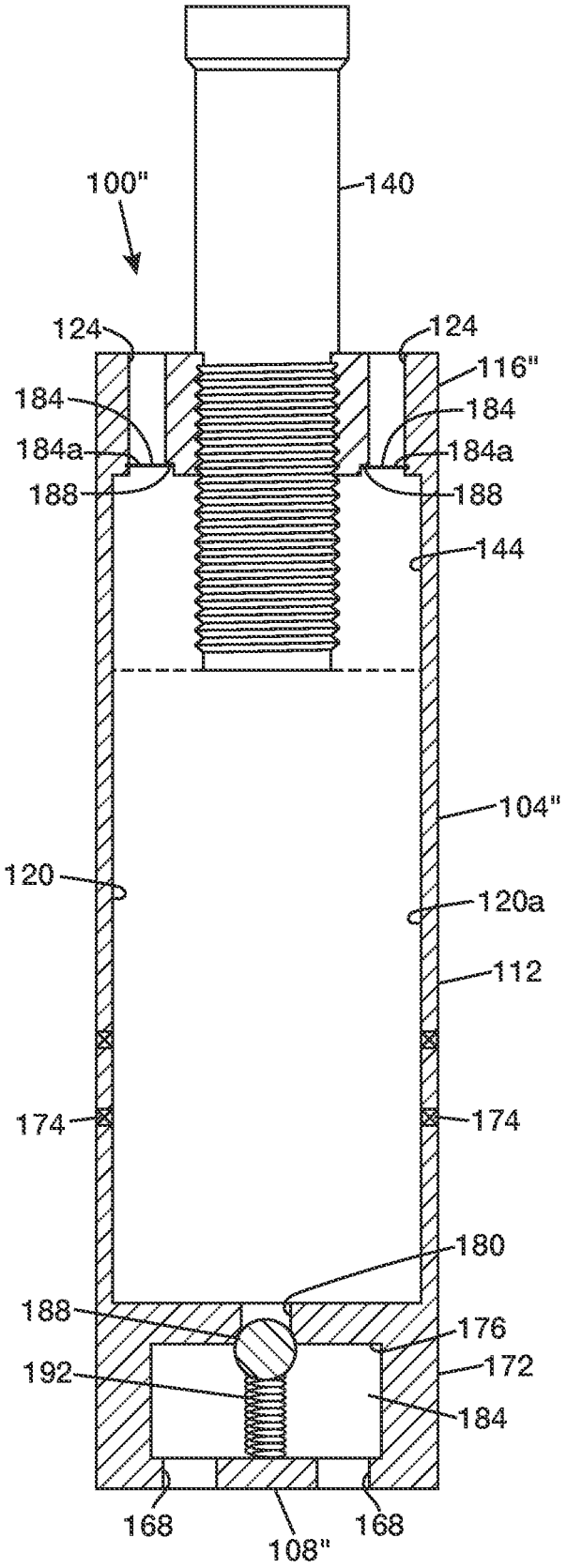
FIG. 5 is a cross-sectional view of an alternative solids collector with flushing capability.

FIG. 5 shows an alternative solids collector 100" where accumulated solids can be flushed out of chamber 120 while the solids collector is in the well, which avoids numerous trips to the surface to empty the solids collector. In this alternative implementation, one or more outlet ports 168 are formed in a bottom wall 108" of receptacle 104". A check valve 172 is arranged to control fluid communication between chamber 120 and outlet ports 168. Check valve 172 includes a valve seat 176 having an orifice 180 and a valve chamber 184. Outlet ports 168 can communicate with orifice 180 through valve chamber 184. A valve element 188, such as a ball, is disposed in valve chamber 184. Valve element 188 is biased against valve seat 176 and orifice 180 by a spring 192. In a normal position, under the action of spring 192, valve element 188 rests against valve seat 176 and closes orifice 180. Spring 192 may be sized to resist the pressure force that can be anticipated at the location of check valve 172 during normal use of solids collector 100", which means that check valve 172 will remain closed during normal use of the solids collector. When a pressure in chamber 120 exceeds the cracking pressure of valve 172, valve element 188 moves away from valve seat 176 and orifice 180, allowing fluid communication between chamber 120 and outlet ports 168 through valve chamber 184. Thus, by applying appropriate pressure to chamber 120, the contents of chamber 120 may be flushed out through outlet ports 168. When the pressure in chamber 120 is below the cracking pressure of valve 172, valve element 188 will again return to the normal position where it closes orifice 180.

Check valves 184 may be arranged in inlet ports 124 formed in top wall 116" of receptacle 104" to control flow into collector-tubing annulus 144. In one example, check valves 184 may be flapper valves or swing-type valves. In one example, a valve element **184*a*, e.g., a flapper, of the check valve 184 is spring-loaded and normally rests against a valve seat 188 formed in top wall 116". Valve elements 184*a* can be pushed down to allow an incoming fluid stream to enter collector-tubing annulus 144 from inlet ports 124. Valve elements 184*a* return to the valve seat 188 when there is no incoming fluid stream or when the pressure of the incoming fluid stream is insufficient to push valve elements 184*a* away from valve seats 188. In this closed position of check valves 184, chamber 120 can be pressurized, e.g., for the purpose of flushing out chamber 120. When chamber 120 is pressurized, fluids and solids within chamber 120 can push on valve elements 184*a* from below. However, since valve elements 184*a* rest firmly against valve seats 188, check valves 184** will remain closed.

Solids collector 100" has been illustrated with tubing 140 attached to top wall 116" by a threaded connection. In an alternative implementation, tubing 140 may be attached to top wall 116" by a flanged connection, as previously described with respect to FIG. 2, or by weld connection. Although FIG. 5 shows one check valve 172 at the bottom of receptacle 104", there may be more than one check valve arranged along the bottom of receptacle 104" in other implementations. Other types of check valves besides the one specifically shown may also be used. Check valves may also be arranged at other locations of receptacle, such as at the side wall 112 (indicated symbolically at 174), to allow for flushing of contents out of chamber 120 at different locations.

Figure 6:
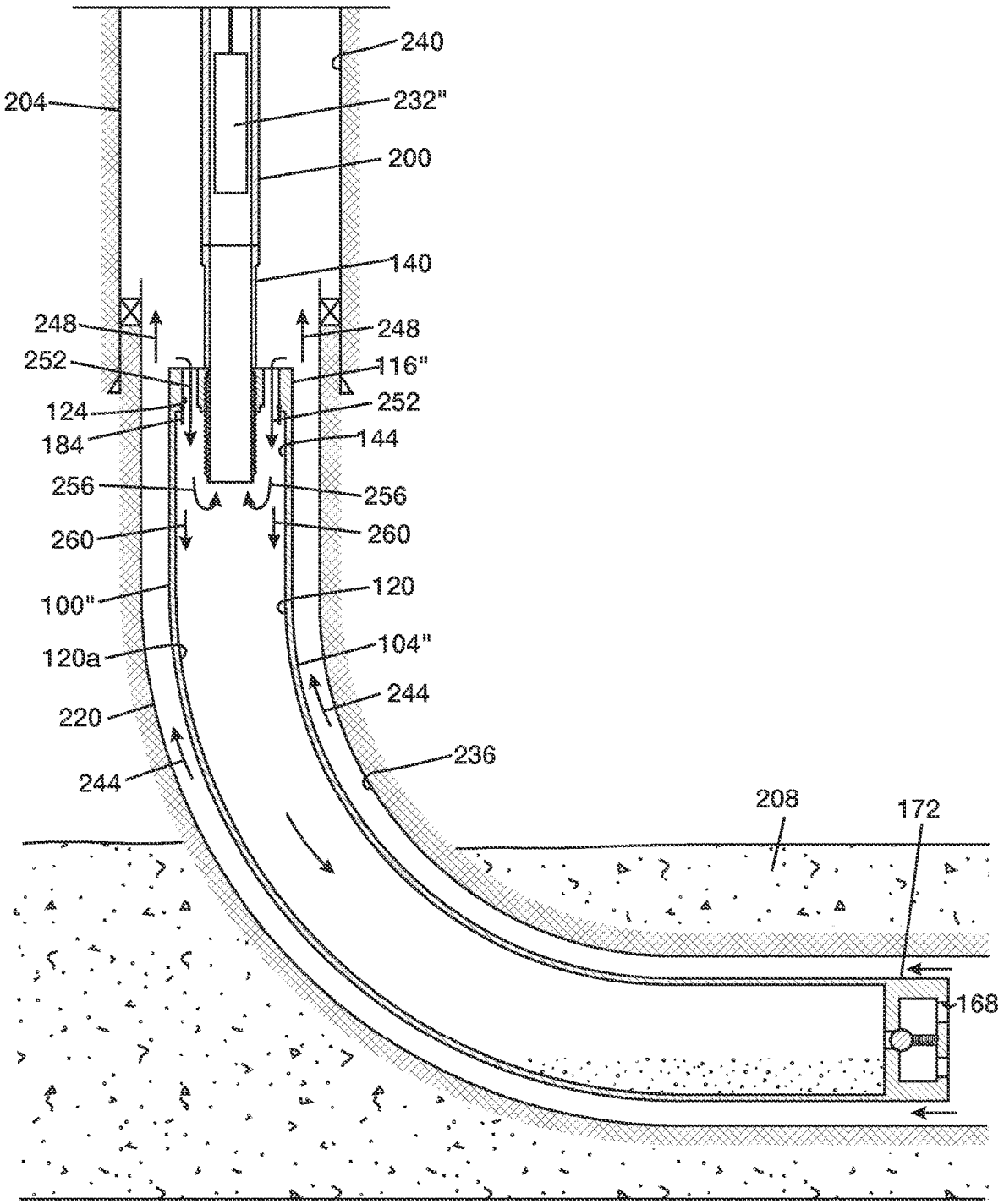
FIG. 6 is a schematic view of a production system including the alternative solids collector of FIG. 5 in a normal production mode.

FIG. 6 shows the system of FIG. 3 modified with solids collector 100", i.e., solids collector 100 in FIG. 3 has been replaced with solids collector 100" in FIG. 6. For the modified system shown in FIG. 6, artificial lift system 232" includes a pump that is operable in a first mode to lift fluids up wellbore tubular 200 and in a second mode to pump fluids into chamber 120 of solids collector 100". One example of such a pump is a progressive cavity pump. During normal production, valve 172 at the bottom of solids collector 100" is closed. A reservoir fluid stream enters collector-casing annulus 236 and moves uphole along collector-casing 236, as shown by arrows 244. At the top of collector-casing annulus 236, the reservoir fluid stream separates into a gas stream that moves uphole along tubing-casing annulus 240 and a solids-liquid stream that reverses in direction and enters inlet port 124. The pressure of the solids-liquid stream opens valves 184, allowing the solids-liquid stream to enter collector-tubing annulus 144, as shown by arrows 252. At the bottom end of tubing 140, the solids-liquid stream separates into a liquid stream that reverses in direction and enters tubing 140, as shown by arrows 256, and solids that continue to move downward into chamber portion **120*a*, as shown by arrows 260. Artificial lift system 232" is operated to pump the liquid stream entering tubing 140 up wellbore tubular 200** to the surface.

Figure 7:
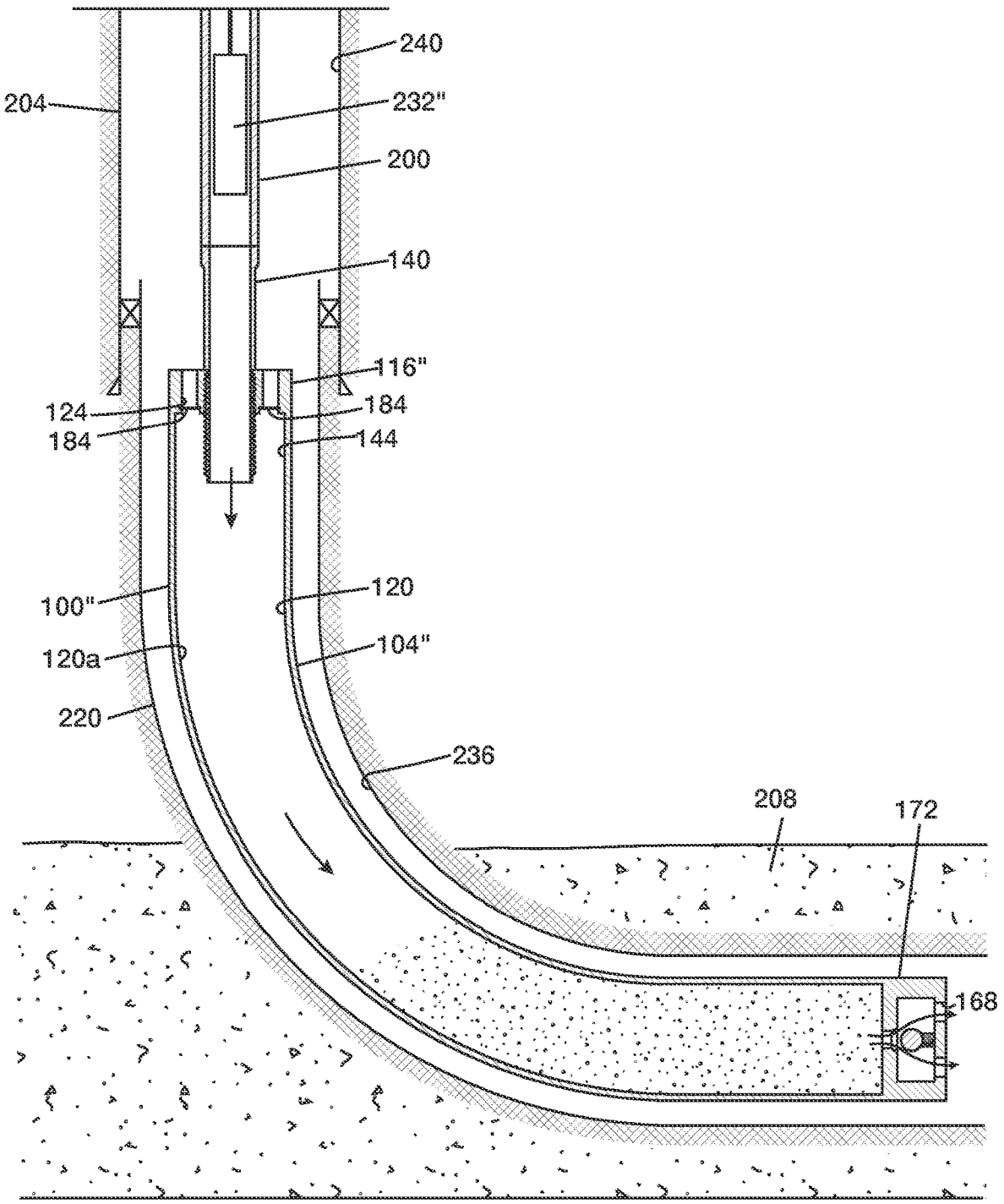
FIG. 7 is a schematic view of the production system of FIG. 6 in a flushing mode.

While the liquid stream is pumped to the surface, the solids settle within chamber 120. When the amount of solids reaches a given level within chamber 120 or at a prescheduled time, production is stopped to allow chamber 120 to be flushed out. When production is stopped, the pressure at inlet ports 124 is reduced such that inlet valves 184 close. To flush the contents of chamber 120 out, artificial lift system 232" is operated in reverse to pump fluid into chamber 120. When the pressure in chamber 120 exceeds the cracking pressure of valve 172, valve 172 opens to allow the contents of chamber 120 to be flushed out through outlet ports 168. FIG. 7 shows valve 172 in an open position that allows flushing out of chamber 120. Once the flushing is complete, artificial lift system 232" can be operated in the normal direction to resume normal production operation. The ability to flush out chamber 120 in the well saves time and cost associated with retrieval of the system to the surface in order to empty the chamber. The operator may still choose to retrieve the system to the surface as part of a field maintenance program. However, due to the flushing capability of the system, the scheduled time between maintenance operations will be longer, which is an added economic benefit to the operator.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. An apparatus comprising:

a receptacle having a top end, a bottom end, and a chamber, the top end having at least one inlet port and a central bore;

a first tubing inserted into the chamber through the central bore;

a second tubing physically and fluidly connected to the first tubing;

an artificial lift system disposed along the second tubing; and an outlet port located on the bottom end and controllable to open the bottom end using an outlet check valve, wherein the outlet check valve comprises:

a valve seat having a valve chamber;

a valve element disposed in the valve chamber and biased against the valve seat by a spring, wherein the spring under separation conditions keeps the valve element covering the outlet port and the spring under cracking pressure conditions allows the valve element to move away from the valve seat into the valve chamber to uncover the outlet port and open the bottom of the receptacle.

2. The apparatus of claim 1, wherein the receptacle includes an inlet check valve positioned to control flow through the at least one inlet port.

3. The apparatus of claim 2, wherein the artificial lift system is operable to pump fluid in a first direction in one mode and in a second direction that is opposed to the first direction in a second mode.

4. The apparatus of claim 3, wherein the first direction includes pumping the fluid to a surface location and the second direction includes pumping the fluid into the receptacle.

5. The apparatus of claim 4, wherein pumping the fluid into the receptacle causes the spring to experience the cracking pressure conditions in order to uncover the outlet port and open the bottom of the receptacle.

* * * * *